US009386681B2

(12) United States Patent
Schmor

(10) Patent No.: US 9,386,681 B2
(45) Date of Patent: Jul. 5, 2016

(54) PARTICLE ACCELERATOR AND METHOD OF REDUCING BEAM DIVERGENCE IN THE PARTICLE ACCELERATOR

(75) Inventor: Paul Schmor, Delta (CA)

(73) Assignee: Schmor Particle Accelerator Consulting Inc., Delta (CA)

( * ) Notice: Subject to any disclaimer, the term of this patent is extended or adjusted under 35 U.S.C. 154(b) by 231 days.

(21) Appl. No.: 14/119,033

(22) PCT Filed: May 22, 2012

(86) PCT No.: PCT/CA2012/050336

§ 371 (c)(1),
(2), (4) Date: Nov. 20, 2013

(87) PCT Pub. No.: WO2012/159212

PCT Pub. Date: Nov. 29, 2012

(65) Prior Publication Data

US 2014/0097769 A1 Apr. 10, 2014

Related U.S. Application Data

(60) Provisional application No. 61/489,148, filed on May 23, 2011.

(51) Int. Cl.

| | |
|---|---|
| ***H05H 13/00*** | (2006.01) |
| ***H05H 7/00*** | (2006.01) |
| ***H05H 15/00*** | (2006.01) |

(52) U.S. Cl.

CPC ..... *H05H 7/00* (2013.01); *H05H 13/005* (2013.01); *H05H 15/00* (2013.01)

(58) Field of Classification Search

None

See application file for complete search history.

(56) References Cited

U.S. PATENT DOCUMENTS

| | | | | |
|---|---|---|---|---|
| 1,948,384 A | | 2/1934 | Lawrence | |
| 3,449,678 A | * | 6/1969 | Wade | H01J 25/49 315/3 |
| 3,767,952 A | | 10/1973 | Ormrod | |

(Continued)

OTHER PUBLICATIONS

Ryckewaert, D. et al., "Status of Cyclone44: A postaccelerator for radioactive ion beams", Proceedings of the 14th International Conference on Cyclotrons and their Applications (Cape Town, South Africa), Jan. 1, 1996, pp. 663-666.

(Continued)

*Primary Examiner* — Douglas W Owens
*Assistant Examiner* — Srinivas Sathiraju
(74) *Attorney, Agent, or Firm* — Nexus Law Group LLP; Nicholas P. Toth

(57) ABSTRACT

An oscillating field particle accelerator and a method of reducing beam divergence in the particle accelerator are provided. The particle accelerator includes an intermediate electrode disposed within the particle accelerator between a source of charged particles and a second electrode of the particle accelerator. The charged particles are exposed to a first electric field extending between the source and the intermediate electrode prior to being exposed to a second electric field extending between the intermediate electrode and the second electrode. The magnitude of the first electric field is less than the peak magnitude of the second electric field, and may be less than or equal to a minimum magnitude of the second electric field occurring during a phase acceptance time period associated with a phase acceptance of the particle accelerator. The accelerated charged particles emerge from the second electrode as a non-diverging or reduced divergence particle beam.

24 Claims, 4 Drawing Sheets

(56) References Cited

U.S. PATENT DOCUMENTS

| | | | | |
|---|---|---|---|---|
| 3,867,705 | A | 2/1975 | Hudson et al. | |
| 3,973,158 | A | 8/1976 | Otten | |
| 4,146,811 | A | 3/1979 | Tran et al. | |
| 4,752,667 | A | 6/1988 | Blanchard et al. | |
| 6,433,494 | B1 * | 8/2002 | Kulish | H05H 1/54 250/251 |
| 7,842,931 | B2 * | 11/2010 | Satoh | H01J 27/024 250/423 R |
| 8,169,167 | B2 * | 5/2012 | Bertozzi | H05H 7/00 315/505 |
| 2005/0283199 | A1 * | 12/2005 | Norling | H05H 13/00 607/33 |
| 2006/0060793 | A1 * | 3/2006 | Lewellen | A61N 5/1001 250/492.1 |
| 2006/0061285 | A1 * | 3/2006 | Lewellen | H01J 3/021 315/5.35 |
| 2007/0001128 | A1 * | 1/2007 | Sliski | H05H 13/02 250/492.3 |
| 2007/0171015 | A1 * | 7/2007 | Antaya | H05H 7/04 335/216 |
| 2009/0140672 | A1 * | 6/2009 | Gall | H05H 13/02 315/502 |
| 2009/0179599 | A1 * | 7/2009 | Bertozzi | H05H 7/00 315/507 |
| 2009/0224700 | A1 * | 9/2009 | Chen | H05H 9/00 315/505 |
| 2009/0230299 | A1 * | 9/2009 | Shichi | H01J 27/10 250/282 |
| 2010/0032580 | A1 * | 2/2010 | Caporaso | H01J 27/26 250/396 R |
| 2010/0128846 | A1 * | 5/2010 | Balakin | A61N 5/1049 378/62 |
| 2012/0037814 | A1 * | 2/2012 | Lal | G21B 1/15 250/396 ML |
| 2014/0070090 | A1 * | 3/2014 | Kostyukevich | H01J 49/38 250/282 |
| 2014/0147921 | A1 * | 5/2014 | Chen | G01N 1/00 436/34 |

OTHER PUBLICATIONS

W. Kleeven, "Injection and extraction for cyclotrons", Proceedings of the Specialised CERN Accelerator School on Small Accelerators (Geneva, Switzerland), Oct. 26, 2006, pp. 271-296.

Zaim and Alton, Computational design studies for an ion extraction system for a "volutme-type" ECR ion source, Review of Scientific Instruments, vol. 73, No. 2, pp. 595-597, Feb. 2002.

Mallory, Hudson and Lord, Cyclotron Internal Ion Source with DC Extraction, IEEE Transactions on Nuclear Science, vol. NS-20, No. 3, pp. 147-150, Jun. 1973.

* cited by examiner

---- PRIOR ART ----

---- PRIOR ART ----

PARTICLE ACCELERATOR AND METHOD OF REDUCING BEAM DIVERGENCE IN THE PARTICLE ACCELERATOR

FIELD OF THE INVENTION

This invention relates to beam dynamics in oscillating field particle accelerators and, in particular, to a method of reducing beam divergence in a particle accelerator, the use of an intermediate electrode for reducing beam divergence in a particle accelerator, and particle accelerators having such intermediate electrode.

DESCRIPTION OF RELATED ART

Oscillating field particle accelerators use electric fields, which are typically made to oscillate at radio frequencies (e.g. from 10 MHz to 3 GHz), to produce an accelerated beam of charged particles after such particles are received from ion sources. Ion sources are sources of electrically charged particles.

Circular particle accelerators, such as cyclotrons, synchrocyclotrons, isochronous cyclotrons, FFAG accelerators, betatrons and synchrotrons, bend the particle beam. For example, circular particle accelerators can use magnetic fields to bend the electrically charged particles along a circular path. Linear accelerators (LINACs) accelerate the beam particles along a straight path inside a straight, elongated chamber.

In a conventional oscillating field particle accelerator with an internal ion source, a beam of charged particles is extracted from the internal ion source via an electric field generated in an acceleration gap defined between an output aperture of the ion source and an electrode, which may be a radio frequency resonator electrode. The electrode includes an aperture from which the particle beam emerges into the main body of the particle accelerator. Initial acceleration of the particle beam occurs in the acceleration gap as a result of a non-zero electric field within the acceleration gap, whereas further beam guidance and acceleration occurring in the main body of the particle accelerator typically involves both electric and magnetic fields and is independent of any interaction with the ion source itself.

However, the particle beam emerging from the electrode through the aperture into the main body of the conventional particle accelerator with an internal ion source is a diverging beam. The fact that the emerging beam is divergent causes beam losses and necessitates beam focusing in the main body of the particle accelerator.

U.S. Pat. No. 3,867,705 to Hudson et al. discloses a slotted dc accelerating electrode positioned between an existing ion source arc chamber and an existing rf accelerating slit, and a source of substantially large negative voltage connected to the dc accelerating electrode, whereby, during operation of the cyclotron, heavy ion beams being accelerated in the cyclotron on harmonics from the 5th to the 11th harmonic have their beam intensities increased from nanoamperes to microamperes by use of the dc accelerating electrode in the cyclotron. However, the substantially large negative voltage connected to the dc accelerating electrode, while increasing beam intensities for the 5th to 11th harmonic of the beam, causes a reduction in focusing and/or increased defocusing of the beam.

In a conventional oscillating field particle accelerator with an external ion source, the external ion source is a stand-alone beam extraction system which may include double-gap acceleration in an 'accel-accel' configuration such that the particle beam at the output of the stand-alone beam extraction system is non-diverging. However, the particle beam produced by the external ion source is a low-energy beam requiring further initial acceleration. The external ion source is connected to the conventional oscillating field particle accelerator such that the particle accelerator receives the particle beam from the external ion source into an acceleration gap of the particle accelerator. The acceleration gap, which is internal to the particle accelerator, has therewithin a non-zero electric field produced by an electrode, which may be a radio frequency resonator electrode. The beam particles are accelerated through the electric field acceleration gap and emerge into the remainder (e.g. main body) of the particle accelerator via an aperture of the electrode.

However, the particle beam emerging from the electrode through its aperture is a diverging beam in a conventional oscillating field particle accelerator with an external ion source.

In a conventional linear accelerator, beam particles are accelerated within an acceleration gap formed between cylindrical or tube-like electrodes which are spaced apart and longitudinally aligned. Every second cylindrical electrode is at ground potential, and a non-zero voltage is applied to every second other electrode interleaved between the ground potential electrodes. The applied voltage produces an electric field in each gap between adjacent cylindrical electrodes, while an electric field is not produced within the cylindrical electrodes themselves. By varying the voltage applied to every second other electrode with appropriate timing, charged particles experience a cascade of accelerating forces when passing through each acceleration gap and "coast" through the cylindrical electrodes. It is known that such configuration of acceleration gaps causes a weak focusing of the linearly accelerated particle beam.

However, the weak focusing of the linear acceleration configuration is insufficient to avoid divergence of particle beams within a linear accelerator.

In a conventional oscillating field particle accelerator, a sinusoidal electrical voltage is applied to the radio frequency resonator electrode. Charged particles being accelerated by the particle accelerator are accepted into the main body of the particle accelerator from an initial acceleration region of the particle accelerator within a range of voltages and corresponding phases about a peak of each 360 degree cycle of the sinusoidal voltage. Within a corresponding range of voltages and associated phases about the opposite polarity peak of each cycle of the sinusoidal voltage, acceleration of the charged particles is reversed and the charged particles are prevented from entering the main body of the particle accelerator. In the case of accelerating positively charged particles or ions, the maximum beam current of the beam entering the main body occurs at or near the negative peak of each cycle of the sinusoidal voltage. Conversely, the maximum beam entry current of a beam of negatively charged particles or ions occurs at or near the positive peak of each cycle of the sinusoidal voltage. Phase acceptance is defined as the phase range within each cycle of the sinusoidal voltage during which the charged particles are accepted into the main body of the particle accelerator. The phase acceptance time period is the time period of each cycle of the sinusoidal voltage during which the charged particles are being accepted into the main body of the particle accelerator.

An object of the invention is to address the above shortcomings.

SUMMARY

The above shortcomings may be addressed by providing, in accordance with one aspect of the invention an oscillating field particle accelerator for accelerating charged particles. The particle accelerator includes an intermediate electrode disposed within the particle accelerator between a source of the charged particles and a second electrode of the particle accelerator, the charged particles being exposed to a first electric field extending between the source and the intermediate electrode prior to being exposed to a second electric field extending between the intermediate electrode and the second electrode, the magnitude of the first electric field being less than a peak magnitude of the second electric field.

The second electrode may have a time-varying voltage applied thereto such that the second electric field is time-varying. The time-varying voltage may be sinusoidal. The intermediate electrode may have a DC voltage applied thereto such that the magnitude of the first electric field is substantially non-varying in time. The intermediate electrode may be disposed closer to the source than the intermediate electrode is to the second electrode. The intermediate electrode may define an intermediate aperture for permitting the charged particles to pass through the intermediate electrode, the intermediate aperture having an oblong shape. The particle accelerator may be a circular type oscillating field particle accelerator. The particle accelerator may be a cyclotron. The second electrode may be an extraction electrode. The source may be internal to the particle accelerator. The magnitude of the first electric field may be less than or equal to a minimum magnitude of the second electric field occurring during a phase acceptance time period associated with a phase acceptance of the particle accelerator. The phase acceptance may be in a range of 0 to 90 degrees. The phase acceptance may be in a range of 20 to 50 degrees. The intermediate electrode may have a voltage applied thereto such that the waveform of the magnitude of the second electric field during the phase acceptance time period and the waveform of the magnitude of the first electric field during a corresponding time period offset from the phase acceptance time period have substantially equal waveform shapes.

In accordance with another aspect of the invention, there is provided a method of reducing divergence of a beam of charged particles in an oscillating field particle accelerator. The method involves passing the charged particles through a first electric field from a source of the charged particles toward an intermediate electrode disposed within the particle accelerator and then passing the charged particles through a second electric field from the intermediate electrode toward a second electrode of the particle accelerator when the magnitude of the first electric field is less than a peak magnitude of the second electric field.

The charged particles may be passed through the second electric field when a time-varying voltage is being applied to the second electrode such that the second electric field is time-varying. The charged particles may be passed when the time-varying voltage is sinusoidal. The charged particles may be passed through the first electric field and then through the second electric field when the intermediate electrode has a DC voltage applied thereto such that the magnitude of the first electric field is substantially non-varying in time. The charged particles may be passed through the first electric field and then through the second electric field when the intermediate electrode is disposed closer to the source than the intermediate electrode is to the second electrode. The charged particles may be passed through the first electric field and then through the second electric field when the intermediate electrode defines an intermediate aperture for permitting the charged particles to pass through the intermediate electrode and the intermediate aperture has an oblong shape. The charged particles may be passed through the first electric field and then through the second electric field when the particle accelerator is a circular type oscillating field particle accelerator. The charged particles may be passed through the first electric field and then through the second electric field when the particle accelerator is a cyclotron. The charged particles may be passed through the first electric field and then through the second electric field when the second electrode is an extraction electrode. The charged particles may be passed through the first electric field and then through the second electric field when the source is internal to the particle accelerator. The charged particles may be passed through the first electric field and then through the second electric field when the magnitude of the first electric field is less than or equal to a minimum magnitude of the second electric field occurring during a phase acceptance time period associated with a phase acceptance of the particle accelerator. The charged particles may be passed through the first electric field and then through the second electric field when the phase acceptance is in a range of 0 to 90 degrees. The charged particles may be passed through the first electric field and then through the second electric field when the phase acceptance is in a range of 20 to 50 degrees. The charged particles may be passed through the first electric field and then through the second electric field when the intermediate electrode has a voltage applied thereto such that the waveform of the magnitude of the second electric field during the phase acceptance time period and the waveform of the magnitude of the first electric field during a corresponding time period offset from the phase acceptance time period have substantially equal waveform shapes.

In accordance with another aspect of the invention, there is provided an oscillating field particle accelerator for accelerating charged particles of a particle beam. The particle accelerator includes: (a) first electric field means for passing the charged particles from a source of the charged particles toward an intermediate electrode disposed within the particle accelerator; (b) second electric field means for passing the charged particles from the intermediate electrode toward a second electrode of the particle accelerator; and (c) beam focusing means for reducing divergence of the beam by the the first electric field means having a magnitude less than a peak magnitude of the second electric field means.

The magnitude of the first electric field may be less than or equal to a minimum magnitude of the second electric field occurring during a phase acceptance time period associated with a phase acceptance of the particle accelerator.

In accordance with another aspect of the invention, there is provided a kit for reducing divergence of a beam of charged particles in an oscillating field particle accelerator. The kit includes an intermediate electrode dimensioned for installation within the particle accelerator between a source of the charged particles and a second electrode of the particle accelerator; and instructions for exposing the charged particles to a first electric field extending between the source and the intermediate electrode prior to being exposed to a second electric field extending between the intermediate electrode and the second electrode, the magnitude of the first electric field being less than a peak magnitude of the second electric field.

In accordance with another aspect of the invention, there is provided an improved oscillating field particle accelerator. The improved particle accelerator includes an intermediate electrode disposed within the particle accelerator between an ion source associated with the particle accelerator and a second electrode of the particle accelerator, the magnitude of a first electric field caused by the intermediate electrode being less than the peak magnitude of a second electric field caused by the second electrode.

The particle accelerator may be a circular particle accelerator. The particle accelerator may be a cyclotron. The particle accelerator may be a linear accelerator.

The ion source may be operable to produce charged particles for forming a particle beam. The ion source may be internal to the particle accelerator. A first region may be defined within the particle accelerator. The first region may be defined between the ion source and the intermediate electrode. The ion source may be an external ion source. The ion source may be a stand-alone ion source. The ion source may be connected to the particle accelerator. The particle accelerator may include a connection for receiving the ion source. The first region may be defined between the connection and the intermediate electrode. The particle beam may travel within the particle accelerator.

The particle accelerator may include an intermediate electrode voltage source for applying an intermediate electrode voltage to the intermediate electrode. The intermediate electrode voltage may be a fixed voltage. The intermediate electrode voltage may be a direct current (DC) voltage. The intermediate electrode voltage may be a time-varying voltage. The intermediate electrode voltage may be an alternating current (AC) voltage or portion thereof. The intermediate electrode voltage may be a pulsed voltage. The intermediate electrode voltage may effect an impulse. The intermediate electrode may be operable to cause the first electric field within the first region. The first electric field may subsist between the ion source and the intermediate electrode. The first electric field may subsist between the connection and the intermediate electrode. The first electric field may subsist within the first region. The first electric field may be caused by the intermediate electrode. The first electric field may be caused by the intermediate voltage. The first electric field may be caused by the intermediate voltage when applied to the intermediate electrode. The intermediate electrode may have a substantially planar shape. The intermediate electrode may be aligned transversely to the direction of travel within the particle accelerator of the particle beam. The intermediate electrode may define an intermediate aperture for permitting beam particles to pass through the intermediate electrode. Beam particles passing through the intermediate electrode may pass through the intermediate aperture of the intermediate electrode. The intermediate aperture may have a rectangular shape. The intermediate aperture may have an elongated shape. The intermediate aperture may form an intermediate aperture slit. The intermediate aperture may be vertically oriented. The intermediate electrode may be ring-shaped. The intermediate electrode may be tube-shaped. The intermediate electrode may form an open-ended cylinder. The intermediate aperture may have a substantially circular cross-section. The first electric field may subsist within the intermediate aperture. The first region may be defined as the volume within the intermediate aperture. Beam particles passing through the intermediate electrode may pass from the intermediate region into a second region.

The second region may be defined within the particle accelerator. The second region may be defined between the intermediate electrode and the second electrode. The second electric field may subsist within the second region. The second electrode may be an extraction electrode. The second electrode may be a final electrode. The second electrode may be a radio frequency resonator electrode. The particle accelerator may include a second electrode voltage source for applying a second electrode voltage to the second electrode. The second electrode voltage may be a fixed voltage. The second electrode voltage may be a direct current (DC) voltage. The second electrode voltage may be a time-varying voltage. The second electrode voltage may be an alternating current (AC) voltage or portion thereof. The second electrode voltage may be a pulsed voltage. The second electrode voltage may effect an impulse.

The second electrode may be operable to cause the second electric field within the second region. The second electric field may subsist between the intermediate electrode and the second electrode. The second electric field may subsist within the second region. The second electric field may be caused by the second electrode. The second electric field may be caused by the second electrode voltage. The second electric field may be caused by the second electrode voltage when applied to the second electrode. The second electrode may have a substantially planar shape. The second electrode may be aligned transversely to the direction of travel within the particle accelerator of the particle beam. The second electrode may define a second aperture for permitting beam particles to pass through the second electrode. Beam particles passing through the second electrode may pass through the second aperture of the second electrode. The second aperture may have a rectangular shape. The second aperture may have an elongated shape. The second aperture may form a second aperture slit. The second aperture may be vertically oriented. The second electrode may be ring-shaped. The second electrode may be tube-shaped. The second electrode may form an open-ended cylinder. The second aperture may have a substantially circular cross-section. The second electric field may subsist within the second aperture. The second region may be defined as the volume within the second aperture. Beam particles passing through the second electrode may pass from the second region into a remaining portion of the particle accelerator. The remaining portion may be a main body of the particle accelerator. Beam particles passing through the second electrode may pass from the second region into a longitudinal non-accelerating region.

The first electric field may have a magnitude that is a fraction of the peak magnitude of the second electric field. The first electric field may have a peak magnitude that is less than the peak magnitude of the second electric field. The first electric field may have an instantaneous magnitude that is at all times less than the instantaneous magnitude of the second electric field. The first electric field may have an average magnitude that is less than the peak magnitude of the second electric field. The first electric field may have a root mean square magnitude that is less than the peak magnitude of the second electric field. The first electric field may have a root mean square magnitude that is less than the peak magnitude of the second electric field. The first electric field may have a peak magnitude that is less than the average magnitude of the second electric field. The first electric field may have a peak magnitude that is less than the root mean square magnitude of the second electric field. The first electric field may have a peak magnitude that is less than the root mean square magnitude of the second electric field. The first electric field may have an average magnitude that is less than the average magnitude of the second electric field. The first electric field may have a root mean square magnitude that is less than the root mean square magnitude of the second electric field. The intermediate electrode voltage may have a magnitude that is a fraction of the peak magnitude of the second electrode voltage. The intermediate electrode voltage may have a peak magnitude that is less than the peak magnitude of the second electrode voltage. The intermediate electrode voltage may have an instantaneous magnitude that is at all times less than the instantaneous magnitude of the second electrode voltage. The intermediate electrode voltage may have an average magnitude that is less than the peak magnitude of the second electrode voltage. The intermediate electrode voltage may have a root mean square magnitude that is less than the peak magnitude of the second electrode voltage. The intermediate electrode voltage may have a peak magnitude that is less than the average magnitude of the second electrode voltage. The intermediate electrode voltage may have a peak magnitude that is less than the root mean square magnitude of the second electrode voltage. The intermediate electrode voltage may have an average magnitude that is less than the average magnitude of the second electrode voltage. The intermediate electrode voltage may have a root mean square magnitude that is less than the root mean square magnitude of the second electrode voltage.

The particle accelerator may be operable to extract charged particles from the ion source. The particle accelerator may be operable to receive beam particles into the first region from the ion source. The particle accelerator may be operable to receive beam particles into the first region from a longitudinal non-accelerating region of the particle accelerator. The particle accelerator may be operable to accelerate beam particles through the first region. The particle accelerator may be operable to accelerate beam particles through the first electric field. The particle accelerator may be operable to cause beam particles to pass through the intermediate aperture. The particle accelerator may be operable to accelerate beam particles through the second region. The particle accelerator may be operable to accelerate beam particles through the second electric field. The particle accelerator may be operable to cause beam particles to pass through the second electrode aperture. The particle accelerator may be operable to cause beam particles to pass through the second electrode aperture so as to form an output particle beam within the particle accelerator. The output particle beam may be a non-diverging beam. The output particle beam may be a particle beam of reduced divergence. The output particle beam may be a converging beam.

In accordance with another aspect of the invention, there is provided a method of reducing divergence of a particle beam in an oscillating field particle accelerator, the method comprising accelerating particles of the particle beam through a first electric field caused by an intermediate electrode disposed within the particle accelerator between an ion source associated with the particle accelerator and a second electrode of the particle accelerator, and accelerating the particles through a second electric field caused by the second electrode and having a peak magnitude greater than the magnitude of the first electric field.

Accelerating particles of the particle beam through a first electric field caused by an intermediate electrode disposed within the particle accelerator between an ion source associated with the particle accelerator and a second electrode of the particle accelerator may involve accelerating the particles through a first region defined as the volume between the ion source and the intermediate electrode. The method may further involve passing the particles through an intermediate aperture of the intermediate electrode. Accelerating particles of the particle beam through a first electric field caused by an intermediate electrode disposed within the particle accelerator between an ion source associated with the particle accelerator and a second electrode of the particle accelerator may involve accelerating the particles through a first region defined as the volume within the intermediate electrode. Accelerating particles of the particle beam through a first electric field caused by an intermediate electrode disposed within the particle accelerator between an ion source associated with the particle accelerator and a second electrode of the particle accelerator may involve accelerating the particles through the intermediate electrode. Accelerating the particles through a second electric field caused by the second electrode and having a peak magnitude greater than the magnitude of the first electric field may involve accelerating the particles through a second region defined as the volume between the intermediate electrode and the second electrode. The method may further involve passing the particles through a second electrode aperture of the second electrode. Accelerating the particles through a second electric field caused by the second electrode and having a peak magnitude greater than the magnitude of the first electric field may involve accelerating the particles through a second region defined as the volume within the second electrode. Accelerating the particles through a second electric field caused by the second electrode and having a magnitude greater than the magnitude of the first electric field may involve accelerating the particles through the second electrode.

In accordance with another aspect of the invention, there is provided a use of the intermediate electrode in the particle accelerator.

In accordance with another aspect of the invention, there is provided a kit for retrofitting an oscillating field particle accelerator. The kit includes an intermediate electrode dimensioned for being installed within the particle accelerator between an ion source associated with the particle accelerator and a second electrode of the particle accelerator, the intermediate electrode being connectable to an intermediate electrode voltage source such that a first electric field caused by the intermediate electrode has a lower magnitude than the peak magnitude of a second electric field caused by the second electrode. The kit may include the intermediate electrode voltage source.

Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention.

DETAILED DESCRIPTION

An oscillating field particle accelerator for accelerating charged particles of a particle beam includes: (a) first electric field means for passing the charged particles from a source of the charged particles toward an intermediate electrode disposed within the particle accelerator; (b) second electric field means for passing the charged particles from the intermediate electrode toward a second electrode of the particle accelerator; and (c) beam focusing means for reducing divergence of the beam by the first electric field means having a magnitude less than a peak magnitude of the second electric field means.

The apparatus in at least one embodiment of the invention includes an intermediate accelerating electrode to decrease the divergence of particle beams generated by electric fields in particle accelerators such as cyclotrons.

Figure 1A:
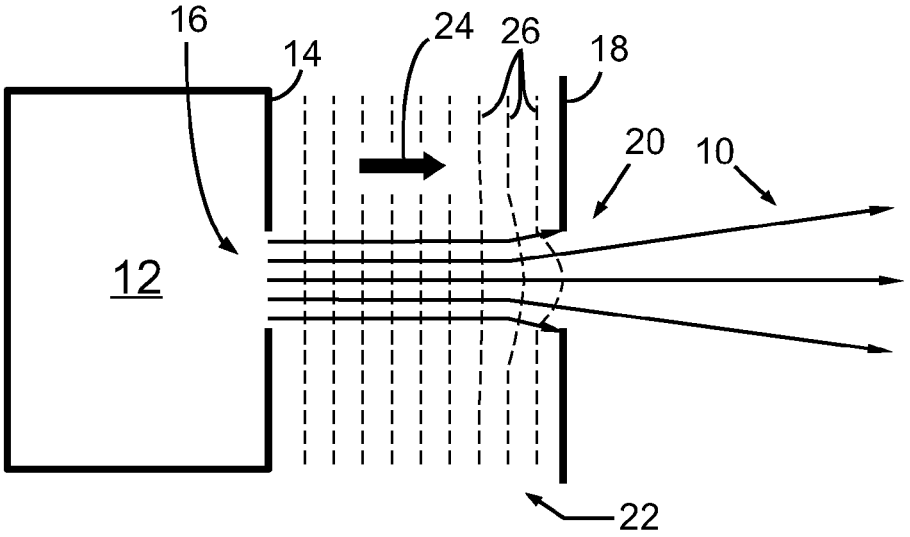
FIG. 1A is a schematic representation of a prior art single-gap configuration, showing a particle beam diverging after exiting the prior art configuration.

Referring to FIG. 1A and by way of explanation, beams 10 of charged particles extracted from ion sources 12 having an ion source wall 14 with an ion source aperture 16 therein and accelerated with a prior art single-gap extraction electrode 18 toward its extraction aperture 20 via the single gap 22 are always divergent (i.e. the single-gap electric field 24, illustrated in FIG. 1A by the solid arrow, resulting from the voltage difference between the voltage of the ion source 12 and the voltage of the extraction electrode 18 forms a lens with a negative focal length). This divergence of the particle beam 10 envelope exiting through the extraction aperture 20 of the extraction electrode 18 frequently leads to unwanted particle beam loss in a particle accelerator.

For ease of illustration, FIG. 1A shows the single-gap electric field 24 in the same direction as the general direction of movement of the charged particles from the ion source 12 toward the extraction electrode 18, as occurs in the case where the charged particles are positively charged, the ion source wall 14 is at ground potential and the extraction electrode 18 is at a negative potential. As is known in the art, the single-gap electric field 24 will have the opposite polarity (not shown) to accelerate negatively charged particles from the ion source 12 toward the extraction electrode 18 in a manner analogous to that shown in FIG. 1A.

FIG. 1A also shows single-gap constant-voltage contours 26 as dashed lines of constant voltage within the single gap 22 extending between the ion source wall 14 and the extraction electrode 18. As illustrated in FIG. 1A, the single-gap electric field 24 accelerates the charged particles of the beam 10 across the single gap 22 along a trajectory which is generally perpendicular to the single-gap constant-voltage contours 26. As also shown in FIG. 1A, the single-gap constant-voltage contours 26 bend near the extraction aperture 20. The single-gap electric field 24 is a vector quantity having a magnitude which may be approximately calculated as the absolute difference between the voltage at the extraction electrode 18 and the voltage at the ion source wall 14, divided by the scalar distance of the single gap 22 extending between the extraction electrode 18 and the ion source wall 14. In a particular example in which the extraction aperture 20 has a circular cross-section and the transit time of the beam 10 charged particles across the single gap 22 is negligibly small compared to the time period of the sinusoidally varying single-gap electric field 24, the single-gap focal length may be approximated as follows:

$$f_{single\text{-}gap} \cong \frac{-4V_0}{\vec{E}_0} = -4g_0$$

where $f_{single\text{-}gap}$ is the single-gap focal length of the prior art configuration shown in FIG. 1A;

$V_0$ is the voltage on the single-gap extraction electrode 18;

$\vec{E}_0$ is the single-gap electric field 24; and $g_0$ is the single gap 22 distance between the ion source wall 14 and the extraction electrode 18.

As can be seen by the approximation formula, the single-gap focal length is negative (due to the single gap 22 distance being a positive scalar value) and hence the beam 10 is a diverging beam 10 as illustrated in FIG. 1A.

Figure 1B:
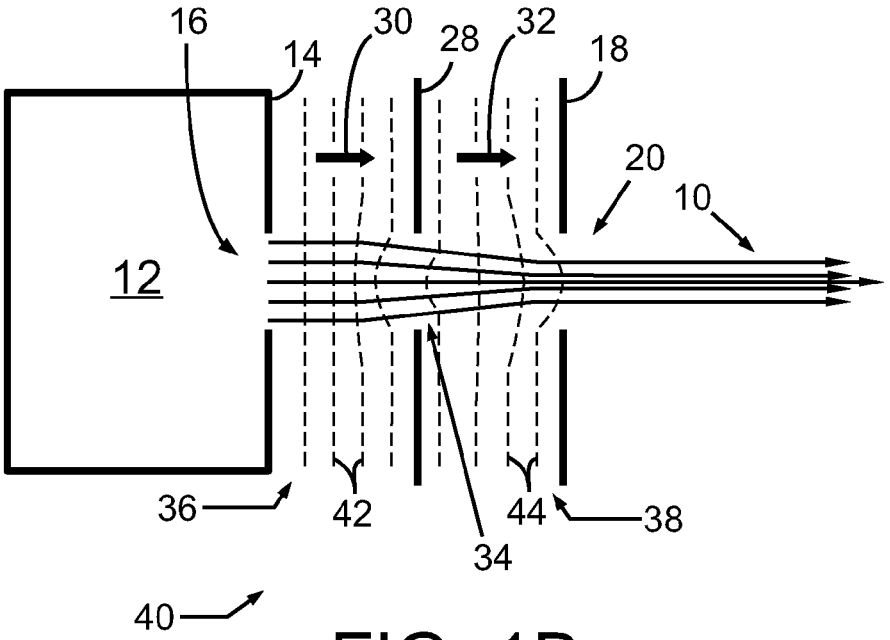
FIG. 1B is a schematic representation of a dual-gap configuration according to an embodiment of the invention, showing reduced divergence of the particle beam after exiting the configuration.

In contrast to the prior art device of FIG. 1A, FIG. 1B shows an intermediate electrode 28 in accordance with an embodiment of the invention placed between the ion source 12 and the final particle beam extraction electrode 18, and voltages are applied to the electrodes 18 and 28 and to the ion source 12 at its wall 14 such that when the magnitude of the first-gap electric field 30 (voltage difference/electrode separation) extending between the intermediate electrode 28 and the ion source wall 14 is less than the magnitude of the second-gap electric field 32 extending between the intermediate electrode 28 and the extraction electrode 18, then the composite lens (i.e. dual acceleration gap 40 configuration) can have a positive focal length and the particle beam divergence is reduced and, with proper parameters, focused through the beam limiting aperture 34 of the intermediate electrode 28 and the beam limiting aperture 20 of the extraction electrode 18. The amount of focusing/defocusing from the lens of the present invention depends on many parameters including, beam 10 energy, voltages on the electrodes 18 and 28, separation distance of the first gap 36 extending between the ion source wall 14 and the intermediate electrode 28, separation distance of the second gap 38 extending between the intermediate electrode 28 and the extraction electrode 18, dimensions of the intermediate electrode aperture 34, and the dimensions of the extraction electrode aperture 20. Implementation of this invention includes appropriately adding the intermediate electrode 28 with appropriate voltages, given electrode separations and aperture dimensions so as to achieve particle beam focusing after crossing the dual acceleration gap 40 formed by the first gap 36 and the second gap 38 within a particle accelerator (not shown in FIG. 1B). The focusing principle is general and, in fact, can be applied to particle accelerators other than cyclotrons. Even though the accelerator gaps used in prior art linear accelerators (LINACs) do, in fact, have a weak, net, positive-focusing force, the focusing can be made even stronger with an intermediate electrode 28 in accordance with an embodiment of the invention that produces a particle beam 10 with smaller transverse dimensions at and exiting from the aperture 20 of the final accelerating electrode 18.

The ion source 12 shown in FIG. 1B may in general be any source of charged particles, including any source of positively charged particles and any source of negatively charged particles, and the particle beam 10 may in general be a beam 10 of any type of charged particles, including ions or other positively or negatively charged particles.

The first-gap electric field 30 and the second-gap electric field 32 are shown in FIG. 1B as having a polarity suitable for accelerating positively charged particles from the ion source 12 toward the extraction electrode 18 (via the intermediate electrode 28). The first- and second-gap electric fields 30 and 32 will have the opposite polarity (not shown) when accelerating negatively charged particles in an analogous manner from the ion source 12 toward the extraction electrode 18.

FIG. 1B shows first-gap constant-voltage contours 42 as dashed lines of constant voltage within the first gap 36, and second-gap constant-voltage contours 44 as dashed lines of constant voltage within the second gap 38. As illustrated in FIG. 1B, the first-gap electric field 30 accelerates the charged particles of the beam 10 across the first gap 36 in a direction which is generally perpendicular to the first-gap constant-voltage contours 42, and the second-gap electric field 32 accelerates the charged particles of the beam 10 across the second gap 38 along a trajectory which is generally perpendicular to the second-gap constant-voltage contours 44. As also shown in FIG. 1B, the first-gap constant-voltage contours 42 bend near the intermediate electrode aperture 34, and the second-gap constant-voltage contours 44 bend near the intermediate electrode aperture 34 and near the extraction aperture 20. The first-gap electric field 30 is a vector quantity having a magnitude which may be approximately calculated as the absolute difference between the voltage at the intermediate electrode 28 and the voltage at the ion source wall 14, divided by the scalar distance of the first gap 36 extending between the ion source wall 14 and the intermediate electrode 28. Similarly, the second-gap electric field 32 is a vector quantity having a magnitude which may be defined generally as the absolute difference between the voltage at the extraction electrode 18 and the voltage at the intermediate electrode 28, divided by the scalar distance of the second gap 38 extending between the intermediate electrode 28 and the extraction electrode 18.

The first and second gaps 36 and 38 shown in FIG. 1B form a dual acceleration gap 40. In a particular example in which the intermediate electrode aperture 34 and the extraction aperture 20 each have a circular cross-section, the space adjacently following the extraction electrode 18 (shown in FIG. 1B as being the illustrated area to the right of the extraction electrode 18) has an electrical potential of zero, and the transit time of the beam 10 charged particles across the second gap 38 is negligibly small compared to the time period of the exemplary sinusoidally varying second-gap electric field 32, the dual-gap focal length may be approximated as follows:

$$f_{dual\text{-}gap} \cong 4g_1 * \left(\frac{\vec{E}_1}{\vec{E}_2 - \vec{E}_1}\right) = \frac{4V_1}{\left(\frac{V_2 - V_1}{g_2}\right) - \left(\frac{V_1}{g_1}\right)}$$

where $f_{dual\text{-}gap}$ is the dual-gap focal length of the dual acceleration gap 40 configuration shown in FIG. 1B;

$V_1$ is the voltage on the intermediate electrode 28;

$\vec{E}_1$ is the first-gap electric field 30;

$g_1$ is the first gap 36 distance between the ion source wall 14 and the intermediate electrode 28;

$V_2$ is the voltage on the extraction electrode 18; and $\vec{E}_2$ is the second-gap electric field 32; and $g_2$ is the second gap 38 distance between the intermediate electrode 28 and the extraction electrode 18.

As can be seen by the dual-gap approximation formula, the dual-gap focal length can be made positive by appropriately selecting parameters of the intermediate electrode 28, such as its location (indicated by the separation distances of the first and second gaps 36 and 38) and its voltage (so as to effect an appropriate relationship between the first-gap electric field 30 and the second-gap electric field 32), thereby causing convergence and/or reducing divergence of the beam 10 as shown in FIG. 1B.

Figure 2A:
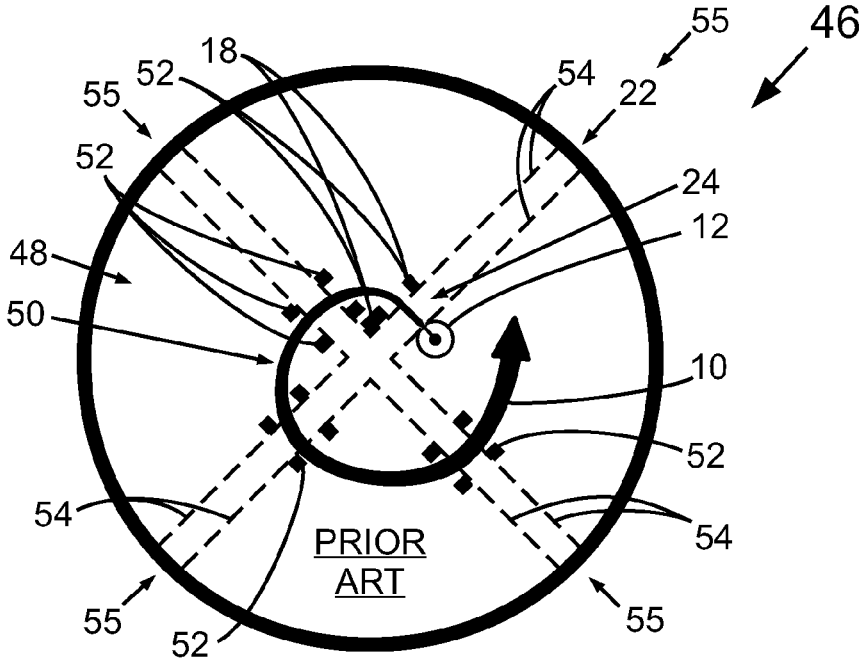
FIG. 2A is a plan view of a prior art cyclotron, showing a diverging beam.

By way of further explanation and with reference to FIG. 2A showing a prior art cyclotron type particle accelerator 46, particle accelerators in general require particle beam 10 focusing during the acceleration process to avoid particle beam 10 loss. Focusing is achieved by using electric and/or magnetic fields to alter the trajectory of particles in a beam 10 in a manner having similarities or analogies with optical lenses and light rays. In a particular example, cyclotrons depend on radial focusing (usually formulated as a focusing frequency, $v_r$, because the focusing is periodic for most of the cyclotron) and vertical focusing (e.g. by frequency $v_z$) of particles in the accelerated beams. At outer regions 48 within a prior art cyclotron 46 where higher beam 10 energies occur in a cyclotron 46, the focusing (vertical and radial) is dominated by appropriate variations of the magnetic field and the electric field focusing is negligible in comparison. However, at or near the centre 50 of the cyclotron 46 where the beam 10 energy is low, the vertical focusing from variations of the magnetic field is small. Within the central region 50 of the cyclotron, the electric field focusing dominates and is necessary to preserve the particle beam properties. In prior art cyclotrons 46 with an internal ion source, the charged particles of the particle beam 10 are extracted through a small aperture in the ion source 12 across a single gap 22 to the ion 'puller' or extraction electrode 18. Usually, the extraction electrode 18 forms part of a radio frequency resonator at high voltage potential such that a time-varying voltage, such as an RF voltage, is applied to the extraction electrode 18. The single-gap electric field 24 across the single gap 22 between the ion source 12 and the 'puller' or extraction electrode 18 forms an electrostatic lens with a negative focal length (i.e; it is defocusing). The defocused beam 10 is shown in FIG. 2A as having a diverging line width to graphically represent such defocusing. The single-gap electric field 24 extracting charged particles from the ion source 12 is usually increased, with the use of electrode 'posts' 52 (to better define the beam exit aperture 20 of the extraction electrode 18) at the accelerating electrode (cyclotron 'dee') (i.e. extraction electrode 18). That is, the extraction electrode 18 may be implemented as a pair of vertical posts 52 located on opposing sides of the beam 10 path. However, in prior art cyclotrons this electrode 18 increases both the radial and vertical divergences of the beam 10 (decreases the $v_r$ and $v_z$). FIG. 2A shows the gaps between the four 'dee' sections of the prior art cyclotron 46 as being bounded by dashed lines 54. The term 'dee' arose historically from the use of two D-shaped sections in the prior art cyclotron 46. Between each 'dee' section is a 'dee' gap 55, one of which is the single gap 22. The 'dee' gap 55 that the beam 10 first encounters upon exiting the ion source 12 within the prior art cyclotron 46 is the single gap 22 disposed between the ion source 12 and the extraction electrode 18. Subsequent 'dee' gaps 55 which the beam 10 encounters after exiting the single gap 22 are visible in FIG. 2A. The beam 10 path in a prior art cyclotron 46 is spiral in shape such that the charged particles of the beam 10 encounter the subsequent 'dee' gaps 55 multiple times. Typically, electrode 'posts' 52 are only used in the central region 50 of the cyclotron 46 for at most the first few turns of the beam 10 and are not used in the outer region 48 of the prior art cyclotron 46.

Some prior art stand-alone (i.e. not internal to an oscillating field particle accelerator) ion beam extraction systems (i.e. ion sources) (not shown) include an intermediate electrode (not shown), in an 'accel-acce' configuration (not shown) used to vary the focal properties of the ion beam extraction system (i.e. ion source) (not shown) to provide a beam at the exit of its extraction electrode (not shown) with smaller radial extent and less angular divergence. However, such prior art 'accel-acce' configurations of stand-alone ion sources are limited to internal configurations of such stand-alone ion sources. A major innovation of the present invention includes applying principles of what is sometimes done within stand-alone ion source extraction systems (i.e. within ion sources) for other applications (not shown) to create novel and inventive first turn dual accelerating gaps 40 in oscillating field particle accelerators such as cyclotrons and other novel and inventive dual acceleration gap 40 configurations of oscillating field particle accelerators.

Figure 2B:
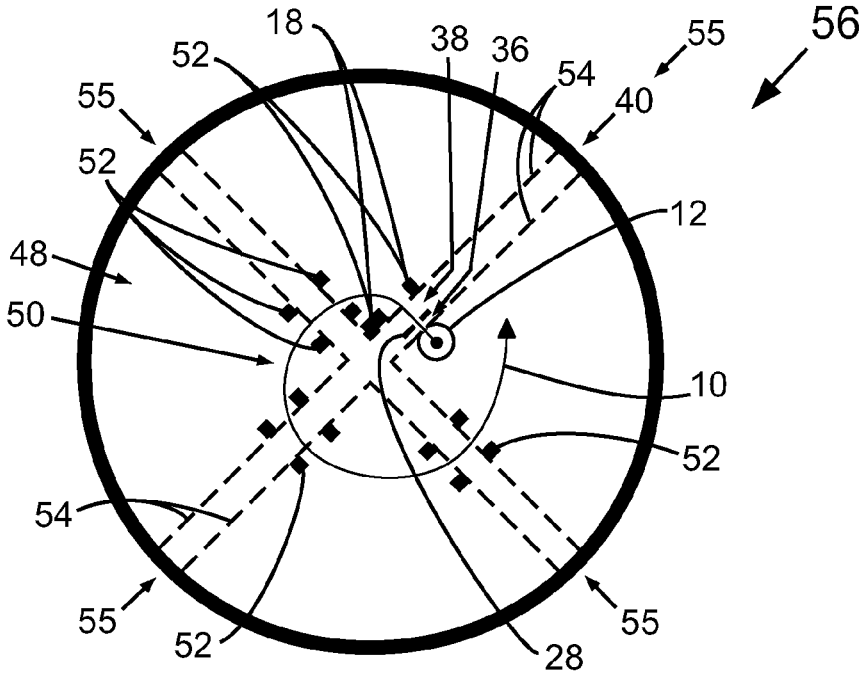
FIG. 2B is a plan view of a cyclotron having an intermediate electrode according to one embodiment of the invention.

In contrast to the prior art configuration of FIG. 2A, FIG. 2B shows the cyclotron 56 according to an embodiment of the invention in which, for example, the intermediate electrode 28 is placed between the 'puller' or extraction electrode 18 and the ion source 12. The ion source 12 is shown in FIG. 2B as being an internal source which is internal to the particle accelerator 56 of FIG. 2B. In conjunction with appropriate separation and applied voltage in accordance with an embodiment of the invention, then the focal length can be positive and the particle beam 10 is focused. The ability to better focus the beam in accordance with an embodiment of the invention has several positive consequences. Beam loss is reduced. Erosion of electrodes by beam loss is reduced. Life time of cyclotron components increases because of the reduction of beam loss. The total accelerated current increases. The improved focusing of the beam 10 in accordance with the present invention is represented graphically in FIG. 2B by a narrow line width of the beam 10.

FIG. 2B also shows the first gap 36, between the ion source 12 and the intermediate electrode 28, and the second gap 38, between the intermediate electrode 28 and the extraction electrode 18, which together form the dual acceleration gap 40. The 'dee' gaps 55, one of which is the dual acceleration gap 40, between the four 'dee' sections of the cyclotron 56 are shown in FIG. 2B as being bounded by the dashed lines 54. The extraction electrode 18 may be implemented as electrode posts 52, as shown in FIG. 2B. While FIG. 2B shows four 'dee' gaps 55 between four 'dee' sections, the present invention is suitable for implementation within cyclotrons and other oscillating field particle accelerators having any number of 'dee' sections and any number of electrode posts 52.

While not shown in the Figures, additional or alternative instances of the intermediate electrode 28 of the present invention may be implemented between a point of entrance of the beam 10 into a given 'dee' gap 55 and an electrode post 52 located at the beam 10 exit from the given 'dee' gap 55, thereby forming a dual acceleration gap 40 configuration in accordance with embodiments of the invention which is subsequent to the dual acceleration gap 40 shown in FIG. 2B.

Referring back to FIG. 2A, another issue in prior art cyclotrons 46 is that the time required for charged particles to transit the 'dee' gap, including the single gap 22 (i.e. the time if takes for particles in a beam to reach full energy after having traveled an effective distance within the 'dee' gap, including the single gap 22) limits the useable extraction voltage and as the extracted current is proportional to $(\text{Voltage})^{3/2}$, the maximum current that can be accelerated is correspondingly limited.

Referring again to FIG. 2B, the introduction of an intermediate electrode 28 into a cyclotron 56 in accordance with an embodiment of the invention, for example, will result in higher accelerated currents associated with the beam 10 of charged particles.

Referring back to FIGS. 1A and 2A, in prior art cyclotrons 46 with external ion sources (not shown in the Figures), a low energy beam 10 is transported to the centre or central region 50 of the prior art cyclotron 46 and bent into the median plane of the prior art cyclotron 46 at an appropriate radius and at a position to be accelerated across a single gap 22 by a single-gap electric field 24 produced by the extraction electrode 18 which can be, for example, a radio frequency resonator electrode 18. As with prior art cyclotrons 46 (FIG. 2A) with internal ion sources 12, the single-gap electric field 24 in this single gap 22 is usually enhanced with the use of 'posts' 52 to decrease the transit time to higher voltage (i.e. to full energy) of charged particles injected into the prior art cyclotron 46. The electrostatic lens formed at this single gap 22 generally has a negative focal length in prior art cyclotrons 46, especially prior art cyclotrons 46 with external ion sources (not shown).

Referring again to FIG. 2B, an appropriately designed intermediate electrode 28 in accordance with an embodiment of the invention would advantageously decrease the divergence following the acceleration.

Another potential application of this technique is to the gaps of LINACs (not shown) accelerating charged particles.

In prior art LINACs (not shown) the particles traverse a linear path in which the particles leave a region of negligible electric field, pass through a collinear gap with high electric field and enter a collinear region with negligible electric field. It is well established and can be calculated for circular apertures, of similar dimensions, that the net effect of such linearly extending accelerating gap is weak focusing. Prior art LINACs require additional focusing elements to maintain a beam within desired dimensions.

In contrast to the prior art LINACs and with reference to FIG. 1B, the introduction of an appropriate intermediate electrode 28 in accordance with an embodiment of the invention in the dual acceleration gap 40 can reduce the transverse size of the beam 10 at the final extraction electrode 18 and thereby enhance the focusing properties of these dual accelerating gaps 40. The increased focusing would advantageously reduce the need for as many expensive focusing elements as are currently used with existing LINACs and consequently also advantageously reduce the required foot print of the LINAC accelerator.

Referring back to FIG. 1A, ions or charged particles are accelerated as beams 10 of particles by particle accelerators. Just as is the case for light beams where optical lenses are used to confine photons in the beams to useable dimensions, the charged particles in particle beams 10 must be regularly focused with the fields from magnetic and electric devices, to confine the particle beams to manageable dimensions. Ions, or charged particles, are created in ion sources such as the ion source 12. The lens properties of electric and magnetic devices are defined in a manner similar or analogous to optics lenses. Ions, or charged particles, are created in ion sources such as the ion source 12, extracted from the ion source to form particle beams 10 and then further accelerated. When the charged particles are extracted from an ion source 12 with a small aperture 16 (planar diode) with a single-gap extraction electrode 18, as in known in the prior art, the resultant beam 10 is always defocusing (see FIG. 1A). For circular apertures 16 and 20, the focal length (f) can be calculated to be about $-4g_0$, where $g_0$ is the distance between the electrodes 14 and 18 for this geometry. This divergence (defocusing because f is always negative for this single-gap electrode arrangement) frequently leads to particle beam loss in the accelerator (not shown in FIG. 1A).

In contrast to the prior art single-gap configuration of FIG. 1A, if an intermediate electrode 28 as shown in FIG. 1B in accordance with an embodiment of the invention is placed between the ion source 12 and the final acceleration (extraction) electrode 18, and voltages are applied to the electrodes 28 and 18 and the ion source wall 14 such that that the first-gap electric field 30 strength (voltage difference/electrode separation) between the intermediate electrode 28 and the ion source wall 14 is less than the second-gap electric field 32 strength between the intermediate electrode 28 and the extractor or extraction electrode 18, then the beam 10 can advantageously be focussed or have reduced defocusing.

FIG. 1B shows schematically this type of electrode arrangement in accordance with an embodiment of the invention. In this case the focal length (with some simplifying assumptions) can be calculated to be about $4V_f/(E_{exit}-E_{entrance})$, where $V_f$ is the voltage gain, $E_{exit}$ is the electric field in the second gap 38 with a gap 38 distance of g2, and $E_{entrance}$ is the electric field at the entrance of the dual acceleration gap 40 (i.e. in the first gap 36) having a gap 36 distance of g1. The intermediate electrode 28 position and voltage can be varied to realize a wide range of ratios for $E_{exit}/E_{entrance}$, the aperture dimensions of the ion source aperture 16, intermediate electrode aperture 34 and the extraction aperture 20 can be arranged to be consistent with beam transverse dimensions, and thereby change the focal length from being positive to negative or vice versa. The typical cyclotron apertures (not shown in FIG. 1B) are rectangular, or otherwise oblong, and not circular. The equations for calculating dual-gap focal length in the case of rectangular or otherwise oblong apertures are more complicated but the focusing/defocusing principle remains the same. The structure described above in relation to embodiments of the invention shows how intermediate electrodes 28 with selected voltages applied thereto can be used to manipulate the focal properties of particle beams 10 in a variety of different particle accelerators (not shown in FIG. 1B), including to advantageously reduce beam divergence of beams 10 exiting dual acceleration gaps 40 as shown in FIG. 1B.

As noted above and with reference to FIGS. 1A and 2A, accelerators require particle beam 10 focusing during the acceleration process to avoid beam 10 loss. In a particular example, prior art cyclotrons 46 depend on radial (usually formulated as a focusing frequency and given the symbol, $v_r$) and vertical focusing ($v_z$) of particles in the accelerated beams. At outer regions 48 within a prior art cyclotron 46 where higher beam 10 energies occur, the beam 10 focusing in a prior art cyclotron 46 is dominated by appropriate variations of the magnetic field and the electric field focusing is negligible in comparison. However at or near the centre 50 of the prior art cyclotron 46 the radial focusing from variations of the magnetic field is small and the electric field focusing dominates.

FIG. 2A schematically shows some of the critical elements found in a prior art cyclotron 46 with an internal ion source 12. In prior art cyclotrons 46, the defocusing problem is usually reduced with the use of electrode posts 52 (referred to as a 'puller' or extraction electrode 52) at the entrance and exit of the 'dee' gap 55 where the beam 10 is accelerated. This is valid for both prior art cyclotrons 46 with internal ion sources 12 and for prior art cyclotrons 46 with external ion sources (not shown). Nevertheless, even with these 'posts' 52, including the extraction electrode 18, the particle beam 10 entering the 'dee' electrode subsequent to exiting the single gap 22 remains radially defocusing in a prior art cyclotron 46.

Referring again to FIG. 2B, an intermediate electrode 28 in accordance with an embodiment of the invention is placed between the 'puller' or extraction electrode 18 and the ion source 12 (or inflector for external ion sources, not shown), with appropriate separation and applied voltage, then the beam 10 advantageously becomes better focused. This technique of embodiments of the invention is suitable for use in cyclotrons 56 with internal ion sources 12 and at the early acceleration gaps (e.g. dual acceleration gaps 40) for cyclotrons 56 with external ion sources (not shown), for example.

Still referring to FIG. 2B, the consequences of being able to better focus the beam 10 through the puller or extraction electrode 18 in accordance with embodiments of the invention are beneficial and numerous. Beam 10 loss is reduced. More particles are accelerated. The particle accelerator of the present invention becomes potentially more efficient with less induced radio-activity which would otherwise result from beam 10 loss. Erosion of electrodes 18 by beam 10 loss is reduced. Life time of cyclotron 56 components increases because of the reduction of beam 10 loss. Beam 10 loss leads to activation of components, component heating, surface sputtering, and erosion of components with eventual component failure. In brief, the total accelerated current increases and the downtime due to beam 10 loss failures decreases.

Referring back to FIGS. 1A and 2A, another issue in prior art cyclotrons 46 is that the time required for particles to transit the 'dee' gap, including the single gap 22, limits the maximum useable extraction voltage and, as the extracted current is proportional to $(\text{Voltage})^{3/2}$, the maximum current that can be accelerated is correspondingly limited under existing schemes.

However, with reference to FIGS. 1B and 2B, this approach of the present invention results in the net transit time being advantageously reduced and the extraction voltage being advantageously higher. Implementing this invention involves adding this intermediate electrode 28 with appropriate voltages and electrode separations so to achieve particle beam focusing or reduced defocusing across the dual acceleration gap 40. The focusing principle is general and, in fact, can be applied to dual accelerating gaps 40 of particle accelerators other than cyclotrons 56.

Referring back to FIGS. 1A and 2A, the single accelerator gaps 22 used in prior art linear accelerators (LINACs) (not shown) do have a weak, net, positive-focusing force.

However, referring to FIG. 1B, the focusing in a LINAC (not shown) can advantageously be made stronger with an intermediate electrode 28 in accordance with an embodiment of the invention that produces a smaller electric field in the first gap 36 compared to the electric field in the second gap 38.

In a first embodiment of the invention and with reference to FIG. 1B, an oscillating field particle accelerator (not shown in FIG. 1B) includes an intermediate electrode 28 disposed between an internal ion source 12 and an extraction electrode 18 of the particle accelerator. The intermediate electrode 28 is formed of a planar sheet aligned transversely to the direction of travel of the particle beam 10. There is an aperture 34 in the planar sheet through which the particle beam 10 may traverse. The aperture 34 may be a rectangular slit aperture, or otherwise be oblong in shape, may be circular or may have any suitable shape for example. There is a voltage source (not shown) applied to the intermediate electrode 28, which may be a fixed, direct current (DC) voltage or may be a time-varying voltage. The magnitude of the first-gap electric field 30 between the ion source 12 and the intermediate electrode 28 is less than the peak magnitude of the second-gap electric field 32 between the intermediate electrode 28 and the extraction electrode 18. The extraction electrode 18 is disposed further from the ion source 12 than is the intermediate electrode 28, thus the extraction electrode 18 is a final electrode 18. In a second embodiment of the invention, an oscillating field particle accelerator (not shown in FIG. 1B) includes a connection to an external ion source (not shown) and includes an internal dual acceleration gap 40 having an input end connected to the external ion source and an output end defined by a final extraction electrode 18 from which a particle beam emerges into the remainder (e.g. main body) of the particle accelerator. In the second embodiment, an intermediate electrode 28 is disposed between the input and output ends of the internal dual acceleration gap 40 such that the intermediate electrode 28 is disposed between the connection to the external ion source (not shown) and the final electrode 18. The intermediate electrode 28 is formed of a planar sheet aligned transversely to the direction of travel of the particle beam 10. There is an aperture 34 in the planar sheet through which the particle beam 10 may traverse. The aperture 34 may be a rectangular slit aperture, or otherwise oblong in shape, may be circular or may have any suitable shape for example. There is a voltage source (not shown) applied to the intermediate electrode 28, which may be a fixed, direct current (DC) voltage or may be a time-varying voltage. The magnitude of the first-gap electric field 30 between the input end and the intermediate electrode 28 is less than then the peak magnitude of the second-gap electric field 32 between the intermediate electrode 28 and the output end.

In a third embodiment of the invention analogously represented by FIG. 1B, a linear particle accelerator (LINAC) (not shown) includes a sequence of longitudinally aligned tube-like or cylindrical electrodes. The cylindrical electrodes are longitudinally spaced apart so as to form linear acceleration gaps between adjacent electrodes. Charged particles are accelerated through these acceleration gaps by electric fields caused by voltage differences existing between adjacent cylindrical electrodes. In the third embodiment, an intermediate electrode, represented by analogy in FIG. 1B by the intermediate electrode 28, having a ring-like or tube-like structure is placed within a dual acceleration gap 40 so as to be longitudinally aligned with, spaced apart from, adjacent to and between an initial cylindrical electrode (typically at ground potential), represented in FIG. 1B by the ion source wall 14, and a final cylindrical electrode (typically having applied thereto a time-varying voltage), which is represented in FIG. 1B by the extraction electrode 18. The ring-like or tube-like structure of the intermediate electrode 28 defines a ring-shaped or tube-shaped intermediate aperture 34. The intermediate aperture 34 may be cylindrical and have a circular cross-section. In the direction of travel of the beam particles through the linear accelerator (not shown), each intermediate electrode 28 precedes its corresponding final electrode 18 and is disposed between an ion source 12 associated with the linear accelerator and its corresponding final electrode 18. In the direction of travel of the beam particles through the linear accelerator, one or more intermediate electrodes 18 may follow adjacently corresponding initial electrodes 14. There is a voltage source applied to the intermediate electrode 28, which may be a fixed, direct current (DC) voltage or may be a time-varying voltage. The voltage applied to the intermediate electrode 28 causes a first-gap electric field 30 to form between the immediately preceding initial electrode 14 and the intermediate electrode 28. The magnitude of the first-gap electric field 30 is related to the voltage difference between the intermediate electrode 28 and its corresponding initial electrode 14. A second-gap electric field 32 is formed between the intermediate electrode 28 and the immediately following final electrode 18, and the magnitude of the second-gap electric field 32 is related to the voltage difference between the intermediate electrode 28 and its corresponding final electrode 18. The magnitude of the first-gap electric field 30 is less than the peak magnitude of the second-gap electric field 32.

Figure 3:
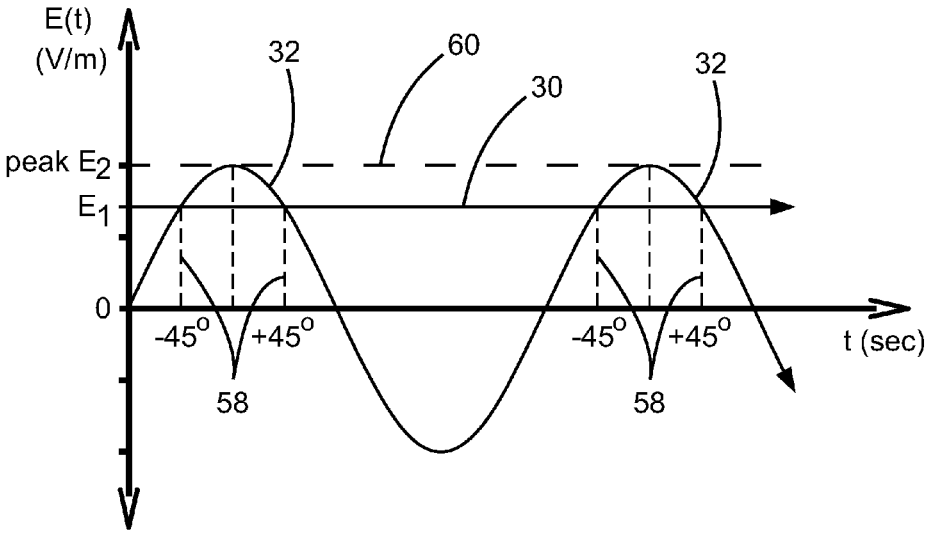
FIG. 3 is a graphical representation of the magnitudes of first and second electric fields in the cyclotron of FIG. 2B, showing electric field magnitudes for accelerating negatively charged particles.
Figure 4:
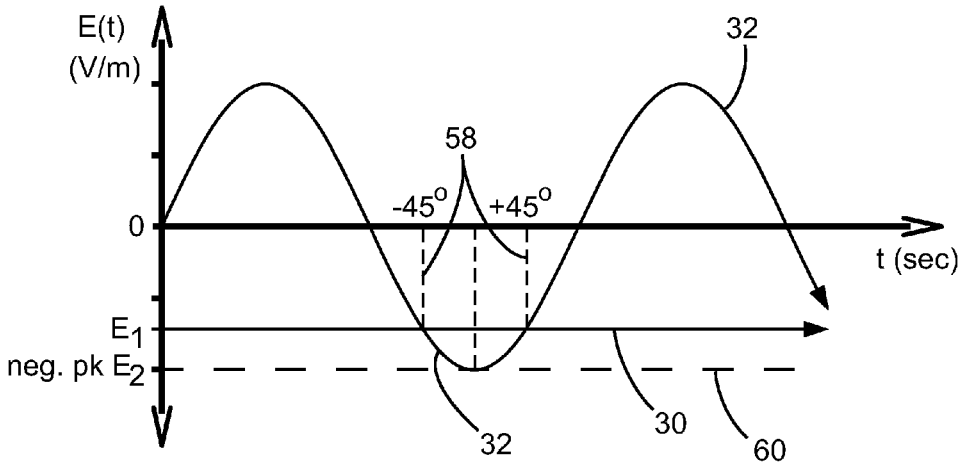
FIG. 4 is a graphical representation of the magnitudes of the first and second electric fields in the cyclotron of FIG. 2B, showing electric field magnitudes for accelerating positively charged particles.

Referring to FIGS. 3 and 4, a sinusoidally time-varying second-gap electric field 32 is shown in accordance with exemplary embodiments of the invention. The second-gap electric field 32 shown in FIGS. 3 and 4 can be created by applying a sinusoidally time-varying voltage to the extraction electrode 18 (FIG. 2B) of the dual accelerating gap 40 (FIG. 2B), for example. In the exemplary embodiment of FIGS. 3 and 4, and for ease of discussion, the ion source wall 14 is at ground potential (i.e. zero volts) relative to the intermediate electrode 28 (FIG. 2B) and the extraction electrode 18 (FIG. 2B).

FIG. 3 represents acceleration of negatively charged particles or ions, in which the first-gap electric field 30 has a positive value, such as may be caused by applying a positive direct current (DC) voltage to the intermediate electrode 28 (FIG. 2B). On the other hand FIG. 4 represents acceleration of positively charged particles or ions, in which the first-gap electric field 30 has a negative value, such as may be caused by applying a negative DC voltage to the intermediate electrode 28 (FIG. 2B). In general, the ion source wall 14 need not be at ground potential relative to the intermediate electrode 28 (FIG. 2B) and the extraction electrode 18 (FIG. 2B), provided the electrical potential of the intermediate electrode 28 is negative relative to electrical potential of the ion source wall 14 when accelerating positively charged ions and positive when accelerating negatively charged ions.

The exemplary phase acceptance of the embodiment of FIGS. 3 and 4 is 90 degrees (from −45 degrees to +45 degrees), as shown in FIGS. 3 and 4 by dashed lines 58. While FIGS. 3 and 4 show the phase acceptance time period as being symmetrical about the occurrence in each cycle of the peak value 60 of the second-gap electric field 32, in general the phase acceptance need not be precisely symmetrical with respect to the peak of the second-gap electric field 32 due to phase lagging or phase leading within the dual acceleration gap 40 configuration. Phase acceptance values other than 90 degrees are possible. For example, phase acceptance is typically in the range of 0 to 90 degrees, and may be in the range of 20 to 50 degrees. In some embodiments, the phase acceptance may be substantially equal to 36 degrees, which corresponds to a percentage acceptance of ten percent of the 360 degree cycle.

In the exemplary embodiments shown in FIGS. 3 and 4, the magnitude of the first-gap electric field 30 is equal to the minimum magnitude of the second-gap electric field 32 occurring during the phase acceptance time period associated with the phase acceptance shown in FIGS. 3 and 4. In variations of embodiments, the first-gap electric field 30 may have a magnitude which is less than (i.e. closer to zero) than the magnitudes of the second-gap electric field 32 for which charged particles will be accepted into the main body of the particle accelerator. Reducing the magnitude of the first-gap electric field 30 relative to the magnitude of the second-gap electric field 32 advantageously increases the focusing and/or decreases the defocusing of the beam 10 of charged particles. However, such reduction in the magnitude of the first-gap electric field 30 can cause a reduction in beam 10 current entering the main body of the particle accelerator. Thus, for some embodiments of the invention an optimal magnitude of the first-gap electric field 30 is equal to the minimum phase acceptance magnitude of the second-gap electric field 32.

Further optimization of embodiments of the invention may be achieved by implementing a time-varying first-gap electric field 30, albeit with the possibility of introducing additional variability in the beam 10 current of the beam 10 entering the main body of the particle accelerator. For example, a first-gap electric field 30 magnitude having a waveform offset from or otherwise corresponding to the second-gap electric field 32 magnitude waveform during phase acceptance can result in desired focusing characteristics of the beam 10 during phase acceptance. By way of example, a first-gap electric field 30 magnitude which is less than the second-gap electric field 32 magnitude by a constant offset magnitude during phase acceptance such that their respective waveform shapes match (not shown) during phase acceptance, albeit with an appropriate phase offset to account for beam 10 transit time through the dual acceleration gap 40 (FIG. 2B), will advantageously result in a constant amount of focusing and/or a constant amount of the reduction in defocusing.

Figure 5B:
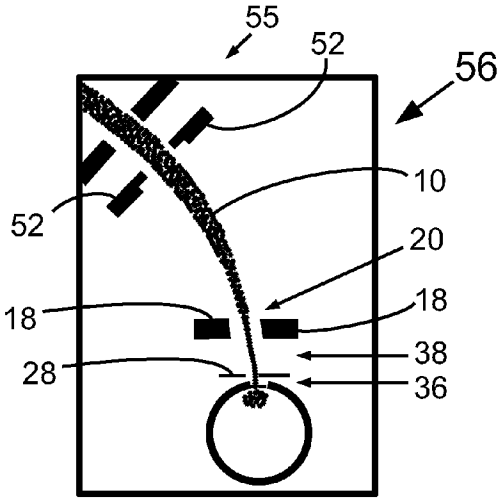
FIG. 5B is a schematic representation of simulation results for the cyclotron of FIG. 2B, showing a beam of reduced divergence.
Figure 5A:
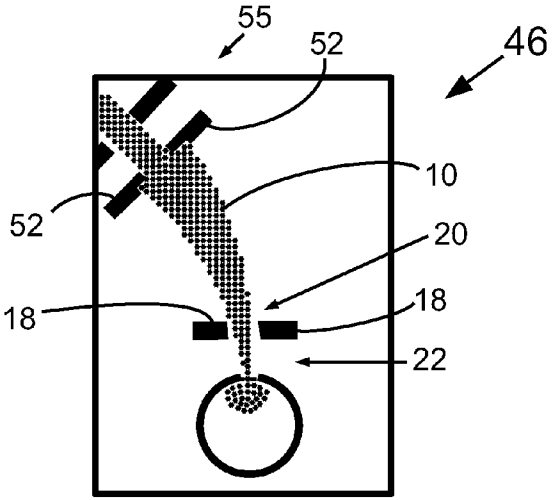
FIG. 5A is a schematic representation of simulation results for the prior art cyclotron shown in FIG. 2A, showing a diverging beam.

Referring to FIGS. 5A and 5B, comparative simulations of beam 10 dynamics have been performed by the inventor of the present invention and comparative simulation results are shown.

FIG. 5A shows a plan view of a portion of a simulated prior art cyclotron 46 in which an ion source 12 and extraction electrode 18 form an initial acceleration single gap 22. Upon exiting the single gap 22, the beam 10 diverges such that a portion of the beam 10 is thereafter blocked when passing a first of subsequent pairs of electrode posts 52 associated with a first subsequent 'dee' gap 55, such that only a limited and small beam 10 current is able to pass into the main body (not shown in FIG. 5A) of the prior art cyclotron 46. When FIG. 5A shows divergence of the beam 10 in the plan view, a similar divergence occurs in the transverse plane as could be seen in a side view (not shown).

FIG. 5B shows a plan view of a portion of a simulated cyclotron 56 having the intermediate electrode 28 positioned between the ion source 12 and the extraction electrode 18, thereby forming the first gap 36 and the second gap 38 of the dual acceleration gap 40 configuration. Upon exiting the dual acceleration gap 40 configuration, the beam divergence is reduced such that less or no portion of the beam 10 is blocked by the first subsequent pair of electrode posts 52 associated with the first subsequent 'dee' gap 55, thereby permitting a larger beam 10 current to pass into the main body of the cyclotron 56. While FIG. 5B shown reduced divergence of the beam 10 in the plan view in accordance with embodiments of the invention, a similar reduction in divergence occurs in such embodiments in the transverse plane as could be seen in a side view (not shown).

Thus, there is provided an oscillating field particle accelerator for accelerating charged particles, the particle accelerator comprising an intermediate electrode disposed within the particle accelerator between a source of the charged particles and a second electrode of the particle accelerator, the charged particles being exposed to a first electric field extending between said source and said intermediate electrode prior to being exposed to a second electric field extending between said intermediate electrode and said second electrode, the magnitude of said first electric field being less than a peak magnitude of said second electric field.

Method of Operation

With reference to FIGS. 1B, 2B, 3, 4 and 5B and the first embodiment of the invention, the internal ion source 12 produces ions or charged particles that form a particle beam 10. Particles of the beam 10 are accelerated through a first region, such as the first gap 36 shown in FIGS. 1B, 2B and 5B, defined between the ion source 12 and the intermediate electrode 28, by a first-gap electric field 30 present in the first gap 36. The first-gap electric field 30 is caused by a voltage applied to the intermediate electrode 28 such that a potential difference between the ion source wall 14 and the intermediate electrode 28 is created. At least some of the beam 10 particles pass from the first gap 36 through an aperture 34 in the intermediate electrode 28 into a second region, such as the second gap 38 shown in FIGS. 1B, 2B and 5B, defined between the intermediate electrode 28 and the extraction electrode 18. There is a second-gap electric field 32 in the second gap 38 which is caused by a voltage applied to the extraction electrode 18 such that a potential difference between the intermediate electrode 28 and the extraction electrode 18 is created. The beam 10 particles passing into the second gap 38 are accelerated by the second-gap electric field 32. At least some of the beam 10 particles accelerated in the second gap 38 pass through an aperture 20 of the extraction electrode 18 to emerge into the remainder of the particle accelerator as an extracted particle beam 10. By appropriately setting the voltage applied to the intermediate electrode 28 and the relative separation distances of the first and second gaps 36 and 38, divergence of the extracted beam 10 can be reduced or eliminated, including causing the extracted beam 10 to converge.

With reference to FIGS. 1B, 2B, 3, 4 and 5B and the second embodiment of the invention, the external ion source (not shown) produces ions or charged particles that form a particle beam 10. Particles of the beam 10 are received into the particle accelerator via a connection between the external ion source and the particle accelerator. Particles of the received beam 10 are accelerated through a first region, such as the first gap 36 shown in FIGS. 1B, 2B and 5B, defined between the ion source 12 and the intermediate electrode 28, by a first-gap electric field 30 present in the first gap 36, in a manner analogous to that of the first embodiment. The remainder of the operation of the second embodiment of the invention is identical, similar or analogous to that of the corresponding operation of the first embodiment.

With reference to FIGS. 1B, 2B, 3, 4 and 5B and the third embodiment of the invention, the ion source associated with the linear accelerator (not shown) is typically an external ion source (not shown) that produces ions or charged particles in the form of a particle beam 10 received into the longitudinal chamber of the linear accelerator. Particles of the beam 10 are successively accelerated in longitudinally aligned acceleration gaps which, in the third embodiment, are configured as dual acceleration gaps 40 having an intermediate electrode 28. Within each dual acceleration gap 40 of the third embodiment, beam 10 particles entering the acceleration gap are accelerated through a first region, such as the first gap 36 shown in FIGS. 1B, 2B and 5B or another first gap analogous thereto, defined adjacent to and preceding the aperture of the ring-like or tube-like intermediate electrode 28 by a first-gap electric field 30 caused by an intermediate electrode 28 voltage applied to the intermediate electrode 28, and then accelerated through a second region, such as the second gap 38 shown in FIGS. 1B, 2B and 5B or another second gap analogous thereto, defined adjacent to and following the aperture 34 of the intermediate electrode 28 by a second-gap electric field 32 caused by the final extraction electrode 18, before exiting the dual acceleration gap 40 into a subsequent non-acceleration region.

Accordingly in embodiments of the invention, the oscillating field particle accelerator receives ions or charged particles in the form of a particle beam from an ion source, passes the beam particles through a first electric field caused by an intermediate electrode of the particle accelerator, and then passes the beam particles through a second electric field caused by an electrode of the particle accelerator such that the particle beam emerging from the second electric field region is of reduced divergence or is a non-diverging particle beam, including a converging particle beam.

Thus, there is provided a method of reducing divergence of a beam of charged particles in an oscillating field particle accelerator, the method comprising passing the charged particles through a first electric field from a source of the charged particles toward an intermediate electrode disposed within the particle accelerator and then passing the charged particles through a second electric field from said intermediate electrode toward a second electrode of the particle accelerator when the magnitude of said first electric field is less than a peak magnitude of said second electric field.

While embodiments of the invention have been described and illustrated, such embodiments should be considered illustrative of the invention only. The invention may include variants not described or illustrated herein in detail. For example, the material of the intermediate electrode may be selected for achieving desired characteristics of the particle beam passing through the intermediate electrode or aperture thereof, including selecting the intermediate electrode material to be an electrically conductive material. Thus, the embodiments described and illustrated herein should not be considered to limit the invention as construed in accordance with the accompanying claims.

What is claimed is:

1. A cyclotron comprising an intermediate electrode disposed between a source of charged particles and a second electrode of the cyclotron, each of said source, said intermediate electrode and said second electrode being internal to the cyclotron, the charged particles being exposed to a first electric field extending between said source and said intermediate electrode prior to being exposed to a second electric field extending between said intermediate electrode and said second electrode, said second electrode having a time-varying voltage applied thereto such that said second electric field is time-varying, the magnitude of said first electric field being less than a peak magnitude of said second electric field.

2. The cyclotron of claim 1 wherein said intermediate electrode has a time-varying voltage applied thereto such that the magnitude of said first electric field is time-varying.

3. The cyclotron of claim 1 wherein said intermediate electrode has a DC voltage applied thereto such that the magnitude of said first electric field is substantially non-varying in time.

4. The cyclotron of claim 1 wherein said intermediate electrode defines an intermediate aperture for permitting the charged particles to pass through said intermediate electrode.

5. The cyclotron of claim 1 wherein the magnitude of said first electric field is less than or equal to a minimum magnitude of said second electric field occurring during a phase acceptance time period associated with a phase acceptance of the cyclotron.

6. The cyclotron of claim 5 wherein said phase acceptance is in a range of 20 to 50 degrees.

7. The cyclotron of claim 5 wherein said intermediate electrode has a voltage applied thereto such that the waveform of the magnitude of said second electric field during said phase acceptance time period and the waveform of the magnitude of said first electric field during a corresponding time period offset from said phase acceptance time period have substantially equal waveform shapes.

8. A method of reducing divergence of a beam of charged particles in a cyclotron, the method comprising passing the charged particles through a first electric field from a source of the charged particles toward an intermediate electrode and then passing the charged particles through a second electric field from said intermediate electrode toward a second electrode when said source, said intermediate electrode and said second electrode are internal to the cyclotron, when a time-varying voltage is being applied to said second electrode such that said second electric field is time-varying, and when the magnitude of said first electric field is less than a peak magnitude of said second electric field.

9. The method of claim 8 wherein passing the charged particles through a first electric field from a source of the charged particles toward an intermediate electrode and then passing the charged particles through a second electric field from said intermediate electrode toward a second electrode comprises passing the charged particles through said first electric field and then through said second electric field when said intermediate electrode has a time-varying voltage applied thereto such that the magnitude of said first electric field is time-varying.

10. The method of claim 8 wherein passing the charged particles through a first electric field from a source of the charged particles toward an intermediate electrode and then passing the charged particles through a second electric field from said intermediate electrode toward a second electrode comprises passing the charged particles through said first electric field and then through said second electric field when said intermediate electrode has a DC voltage applied thereto such that the magnitude of said first electric field is substantially non-varying in time.

11. The method of claim 8 wherein passing the charged particles through a first electric field from a source of the charged particles toward an intermediate electrode and then passing the charged particles through a second electric field from said intermediate electrode toward a second electrode comprises passing the charged particles through said first electric field and then through said second electric field when said intermediate electrode defines an intermediate aperture for permitting the charged particles to pass through said intermediate electrode.

12. The method of claim 8 wherein passing the charged particles through a first electric field from a source of the charged particles toward an intermediate electrode and then passing the charged particles through a second electric field from said intermediate electrode toward a second electrode comprises passing the charged particles through said first electric field and then through said second electric field when the magnitude of said first electric field is less than or equal to a minimum magnitude of said second electric field occurring during a phase acceptance time period associated with a phase acceptance of the cyclotron.

13. The method of claim 12 wherein passing the charged particles through said first electric field and then through said second electric field when the magnitude of said first electric field is less than or equal to a minimum magnitude of said second electric field occurring during a phase acceptance time period associated with a phase acceptance of the cyclotron comprises passing the charged particles through said first electric field and then through said second electric field when said phase acceptance is in a range of 20 to 50 degrees.

14. The method of claim 12 wherein passing the charged particles through said first electric field and then through said second electric field when the magnitude of said first electric field is less than or equal to a minimum magnitude of said second electric field occurring during a phase acceptance time period associated with a phase acceptance of the cyclotron comprises passing the charged particles through said first electric field and then through said second electric field when said intermediate electrode has a voltage applied thereto such that the waveform of the magnitude of said second electric field during said phase acceptance time period and the waveform of the magnitude of said first electric field during a corresponding time period offset from said phase acceptance time period have substantially equal waveform shapes.

15. A cyclotron comprising:

(a) first electric field means for passing charged particles through a first electric field from a source of the charged particles toward an intermediate electrode when said source and said intermediate electrode are internal to the cyclotron;

(b) second electric field means for passing the charged particles through a second electric field from said intermediate electrode toward a second electrode when said second electrode is internal to the cyclotron;

(c) time-varying field means for applying a time-varying voltage to said second electrode such that said second electric field is time-varying; and (d) beam focusing means for causing the magnitude of said first electric field to be less than a peak magnitude of said second electric field.

16. The cyclotron of claim 15 wherein said first electric field means causes said first electric field to be time-varying.

17. The cyclotron of claim 15 wherein said beam focusing means causes the magnitude of said first electric field to be less than or equal to a minimum magnitude of said second electric field occurring during a phase acceptance time period associated with a phase acceptance of the cyclotron.

18. The cyclotron of claim 17 further comprising waveform shaping means for applying a voltage to said intermediate electrode such that the waveform of the magnitude of said second electric field during said phase acceptance time period and the waveform of the magnitude of said first electric field during a corresponding time period offset from said phase acceptance time period have substantially equal waveform shapes.

19. A kit for reducing divergence of a beam of charged particles in a cyclotron, the kit comprising an intermediate electrode dimensioned for installation within the cyclotron between a source of the charged particles and a second electrode of the cyclotron, said source and said second electrode being internal to the cyclotron, and instructions for exposing the charged particles to a first electric field extending between said source and said intermediate electrode prior to exposing the charged particles to a second electric field extending between said intermediate electrode and said second electrode, said second electrode having a time-varying voltage applied thereto such that said second electric field is time-varying, the magnitude of said first electric field being less than a peak magnitude of said second electric field.

20. The kit of claim 19 wherein said intermediate electrode defines an intermediate aperture for permitting the charged particles to pass through said intermediate electrode.

21. The cyclotron of claim 1 wherein said intermediate electrode is formed of a planar sheet aligned transversely to a direction of travel of the charged particles.

22. The method of claim 8 wherein passing the charged particles through a first electric field from a source of the charged particles toward an intermediate electrode and then passing the charged particles through a second electric field from said intermediate electrode toward a second electrode comprises passing the charged particles through said first electric field and then through said second electric field when said intermediate electrode is formed of a planar sheet aligned transversely to a direction of travel of the charged particles.

23. The cyclotron of claim 15 wherein said intermediate electrode is formed of a planar sheet aligned transversely to a direction of travel of the charged particles.

24. The kit of claim 19 wherein said intermediate electrode is formed of a planar sheet dimensioned for being installed in transverse alignment to a direction of travel of the charged particles.

* * * * *